US007861733B2

(12) United States Patent
Pellikaan et al.

(10) Patent No.: US 7,861,733 B2
(45) Date of Patent: Jan. 4, 2011

(54) DEVICE FOR TREATING PIECES OF A SUBSTRATE AT HIGH PRESSURE WITH A SUPERCRITICAL OR NEAR-CRITICAL TREATMENT MEDIUM, PIECE BY PIECE OR IN BATCHES

(75) Inventors: Hubert Clemens Pellikaan, Utrecht (NL); Geert Feye Woerlee, Amsterdam (NL)

(73) Assignee: Stork Prints B.V., Boxmeer (NL)

( * ) Notice: Subject to any disclaimer, the term of this patent is extended or adjusted under 35 U.S.C. 154(b) by 1288 days.

(21) Appl. No.: 11/327,927

(22) Filed: Jan. 9, 2006

(65) Prior Publication Data

US 2006/0157091 A1 Jul. 20, 2006

(30) Foreign Application Priority Data

Jan. 14, 2005 (NL) ..... 1028037

(51) Int. Cl.
*B08B 3/04* (2006.01)

(52) U.S. Cl. ..... 134/186; 134/25.1; 134/60; 134/182

(58) Field of Classification Search ..... None
See application file for complete search history.

(56) References Cited

U.S. PATENT DOCUMENTS 3,994,805 A * 11/1976 Ito ..... 210/635
5,267,455 A 12/1993 Dewees et al.
5,563,391 A * 10/1996 Dahm ..... 219/121.64
6,351,973 B1 3/2002 McClain et al.
6,412,312 B1 * 7/2002 McClain et al. ..... 68/18 C
6,427,479 B1 * 8/2002 Komatsubara et al. ..... 62/503
2005/0120491 A1 * 6/2005 Woerlee et al. ..... 8/142
2006/0125337 A1 * 6/2006 Levnat ..... 310/87

FOREIGN PATENT DOCUMENTS

JP 2001-012352 * 1/2001
JP 2003117513 4/2003
WO WO00/63483 10/2000

OTHER PUBLICATIONS

Machine Translation of JP2001-012352 by Sanuki et al., published Jan. 16, 2001.*
English Patent Abstract for JP 2003 117513.

* cited by examiner

*Primary Examiner*—Michael Kornakov
*Assistant Examiner*—Ryan Coleman
(74) *Attorney, Agent, or Firm*—Hoffmann & Baron, LLP

(57) ABSTRACT

A device for treating pieces of a substrate at high pressure, piece by piece or in batches, with a treatment medium in the supercritical or near-critical state, includes a first pressure chamber, a pipe system for supplying and discharging the treatment medium, to and from the pressure chamber under high pressure and an electric motor, which is fixed to the housing in the first pressure chamber or in a second pressure chamber coupled to the first pressure chamber under the high pressure, for driving an actuator to carry out a mechanical action in the treatment medium. The electric motor is in this case open to the treatment medium and is disposed and designed to be accessible to the treatment medium, in such a manner that during the treatment of a substrate the treatment medium flows through and around the electric motor.

17 Claims, 3 Drawing Sheets

DEVICE FOR TREATING PIECES OF A SUBSTRATE AT HIGH PRESSURE WITH A SUPERCRITICAL OR NEAR-CRITICAL TREATMENT MEDIUM, PIECE BY PIECE OR IN BATCHES

CROSS-REFERENCE TO RELATED APPLICATIONS

This application claims the benefit of Dutch Patent Application No. NL 1028037, filed Jan. 14, 2005, the contents of which is incorporated herein by reference.

FIELD OF THE INVENTION

The invention relates to a device for treating pieces of a substrate with a supercritical or near-critical treatment medium, which may for example comprise $CO_2$, $N_2O$, lower alkanes, such as ethane and propane, or mixtures thereof, at high pressure in a pressure chamber, piece by piece or in batches, with a mechanical action being carried out in the treatment medium.

BACKGROUND OF THE INVENTION

The prior art has disclosed a number of variants of a device of this type, in which an electric motor is used as drive for carrying out the mechanical action. However, the said treatment media have the drawback of dissolving many polymers therein. This can give rise to problems with regard to sticking, softening and expansion or even bursting of the polymer if it comes into contact with the treatment medium. This problem becomes more serious the higher the density of the treatment medium, such as for example in liquid or supercritical phases of the treatment medium under ever higher pressures. This may give rise to considerable problems in the event of an electric motor coming into contact with treatment media of this type, for example short-circuiting as a result of the electrical insulation of the motor windings being affected, leaks caused by damage to any sealing rings, and jamming caused by fretting of plastic bearing components. Furthermore, treatment media of this nature are able to dissolve may oils and greases. This leads to removal of grease from anything which comes into contact with the treatment medium. This problem is likewise exacerbated as the density of the treatment medium rises. In the case of the electric motor, this can give rise to problems with lubricated surfaces in the bearing of the motor shaft, as well as with any bearings used in the mechanical actuator.

To avoid the above complications, the electric motor can be positioned outside the sphere of influence of the treatment medium, i.e. outside the pressure chamber. The mechanical actuator provided inside the pressure chamber is then driven by a drive shaft which passes through a wall of the pressure chamber. However, this presents specific problems with the need to seal the drive shaft. Sealing problems of this nature are exacerbated at higher pressures of the treatment medium, resulting in an expensive structure.

An alternative is to make use of a magnetic coupling between the electric motor and the mechanical actuator, as shown for example in U.S. Pat. No. 5,267,455. There is no need for seals in this case. However, at high pressures, the wall thickness of the pressure chamber increases and consequently the magnetic coupling is more difficult to realize, certainly if high powers need to be transmitted. This leads to very expensive structures.

WO 00/63483 also discloses a device showing a washing machine drum which is driven by an electric motor. In this case, the washing machine drum and the electric motor are both located in a treatment space which is partially filled with highly pressurized liquid $CO_2$ at room temperature. The document describes the electric motor having to be disposed as high as possible within the top part of the treatment space, so that the electric motor substantially, i.e. barring a few splashes of liquid $CO_2$, only comes into contact with gaseous $CO_2$.

One drawback in this case is that this known device is susceptible to faults and problems may still arise as a result of standard polymer components of the electric motor being adversely affected. Furthermore, the working range of the permitted pressure and temperature are limited, and consequently in some cases so is the effectiveness of the washing treatment which is intended in this case.

SUMMARY OF THE INVENTION

It is an object of the invention to at least partially overcome the abovementioned drawbacks and/or to create a useable alternative. In particular, it is an object of the invention to create a reliable and efficient device for treating pieces of a substrate at high pressure, piece by piece or in batches, with a treatment medium in the supercritical or near-critical state.

This object is achieved by a device according to the present invention. In this case, the device comprises a first pressure chamber, which is provided with a closable feed opening for placing pieces of substrate in the pressure chamber, and a pipe system for supplying and discharging the treatment medium, which may comprise, for example, $CO_2$, $N_2O$, lower alkanes, such as ethane and propane, or mixtures thereof, to and from the pressure chamber under high pressure. In the first pressure chamber or in a second pressure chamber coupled to the first pressure chamber under the high pressure, there is an electric motor for driving an actuator to carry out a mechanical action in the treatment medium. The electric motor is in this case open to the treatment medium and the electric motor is disposed and designed to be accessible to the treatment medium, in such a manner that during the treatment of a substrate the supercritical or liquid treatment medium flows through and around the electric motor.

Surprisingly, it has been found that, despite the drawbacks described in the prior art, it is none the less readily possible for an electric motor to be designed in such a manner that it can be exposed from the inside and the outside to the supercritical or near-critical liquid treatment medium and is able to withstand it. In the invented device, the electric motor is located in the process tank at the high process pressure; this high pressure prevails both outside and inside the electric motor. The pressure inside the motor casing is then advantageously substantially equal to the pressure outside the electric motor, i.e. in the relevant pressure chamber. As a result, the electric motor can be of simpler and less expensive design. Inter alia, there is no need for a seal between the motor shaft and the motor casing, and the casing does not need to have any additional structural strength in order to withstand high pressure differences. Another advantage is that the supercritical or near-critical liquid treatment medium contributes to cooling the electric motor. Put another way, the heat which is dissipated by the electric motor can advantageously be used to keep the treatment medium at process temperature during the treatment of a substrate.

The motor windings of the electric motor may be insulated using insulation material which is resistant to the specific treatment medium, and it is possible to use a lubrication-free bearing for a motor output shaft of the electric motor. These measures make it more readily possible for the device to function without problems under various operating conditions, in particular even at pressures and temperatures which are so high that the treatment medium is in the supercritical or near-supercritical phase.

The electric motor may comprise a motor casing which is provided with inlet openings for allowing the treatment medium to flow into the electric motor as far as around the motor windings. The inlet openings allow the treatment medium to flow freely through the interior of the electric motor, with the result that successful cooling of the motor windings can be achieved. For example, there is no longer any need for cooling fins on the motor casing.

Further preferred embodiments are defined in the subclaims.

The invention also relates to the use of a device for treating pieces of textile substrate at high pressure, piece by piece or in batches. Additionally, the invention relates to use of a device for treating pieces of a substrate at high pressure, piece by piece or in batches, with a treatment medium wherein the pressure and temperature at which the treatment medium is supplied to a pressure chamber during treatment are such that the treatment medium is in a supercritical or near-critical state, and in which an electric motor for driving an actuator for carrying out a mechanical action in the treatment medium is located in the treatment medium, which is in the supercritical or near-critical state, with the treatment medium flowing through and around it. Further, the invention relates to use of a device for treating pieces of a substrate at high pressure, piece by piece or in batches, with a treatment medium in particular according to one of the preceding claims, wherein the pressure and temperature at which the treatment medium is supplied to a pressure chamber during treatment are such that the treatment medium is at least partially in a liquid phase, and in which an electric motor for driving an actuator for carrying out a mechanical action in the treatment medium is submerged in the treatment medium, which is in the liquid phase, with the treatment medium flowing through and around it.

The invention also relates to an electric motor for a device which is open to the treatment medium and is designed to be accessible to the treatment medium, in such a manner that during treatment of a substrate with a treatment medium, the treatment medium can flow through and around the electric motor.

BRIEF DESCRIPTION OF THE DRAWINGS

The invention will be explained in more detail with reference to the appended drawing, in which.

DESCRIPTION OF THE PREFERRED EMBODIMENT

Figure 1:
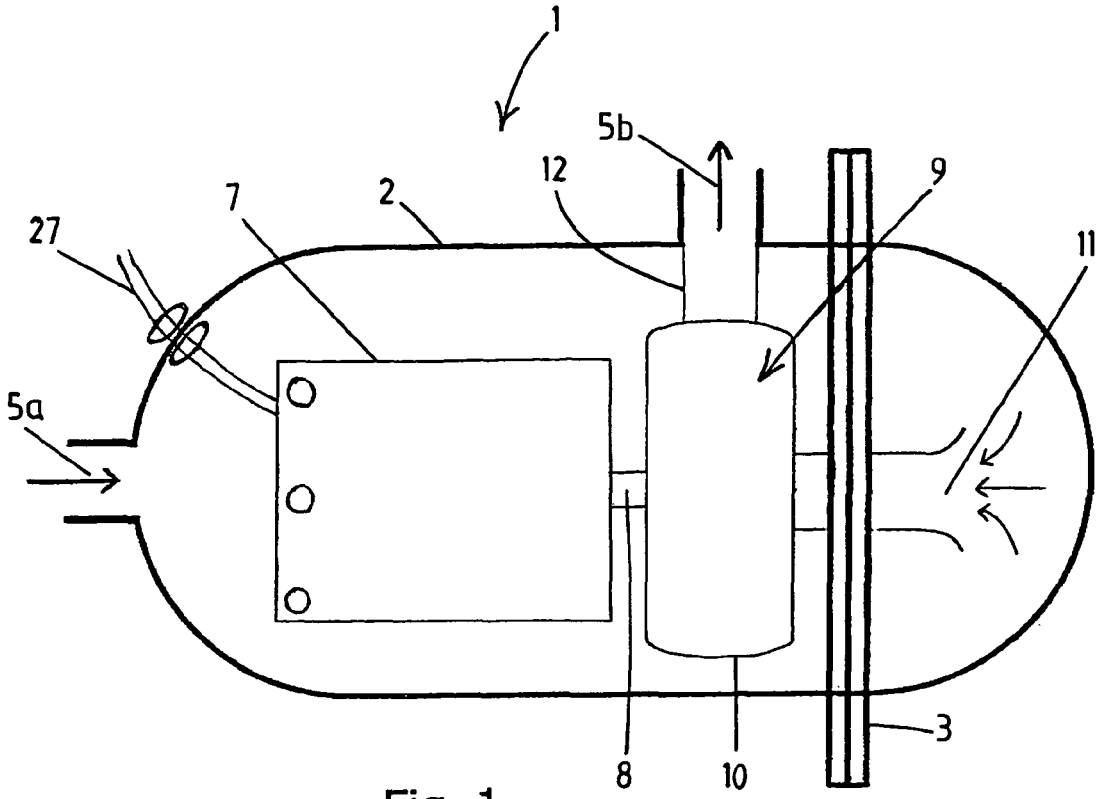
FIG. 1 shows a diagrammatic view of an embodiment of a pressure chamber with an electric motor fixed to the housing therein, for a device according to the invention with pump.

In FIG. 1, the pressure chamber device as a whole is denoted by reference numeral 1. The device 1 comprises a pressure chamber 2, which is in this case formed by a pressure vessel and is provided with an opening, which can be closed by a cover 3, for mounting an electric motor 7 with pump 9 in the pressure vessel. There is also a pipe system 5 with a feed 5*a* and a discharge 5*b*. An electric motor 7 is disposed in the pressure chamber 2. A pump 9 is mounted on the motor output shaft 8 of the electric motor 7. The pump 9, which is formed for example by a centrifugal pump with an impellor, is in this case mounted directly on the motor shaft 8. The pump 9 is accommodated in a pump casing 10 which comprises an inlet 11 and an outlet 12. The outlet 12 is connected to the discharge 5*b*.

The pressure chamber device shown may be incorporated as a second pressure chamber in a high-pressure circuit with a first pressure chamber for treating a substrate.

Figure 2:
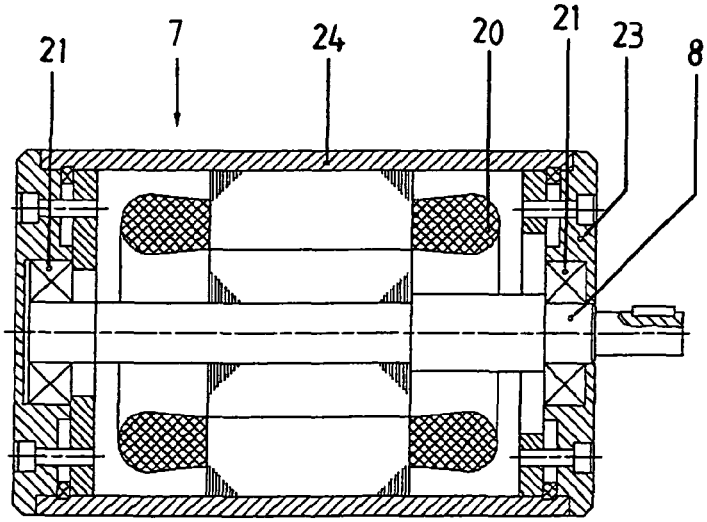
FIG. 2 shows a cross-sectional view through an electric motor which can be used in a device as shown in one of FIGS. 1, 4, 5 and 6.
Figure 3:
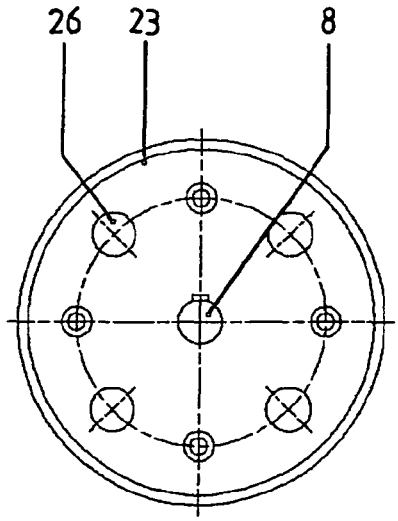
FIG. 3 shows a side view of FIG. 2.

The electric motor 7, which is shown in more detail in FIGS. 2 and 3, comprises motor windings 20 which are insulated by an insulation material that is able to withstand a treatment medium that is specifically to be used, comprising $CO_2$, $N_2O$, lower alkanes, such as ethane and propane, or mixtures thereof. The insulation material preferably consists of polyester. Tests have shown that this is an eminently satisfactory material. Other materials, such as kapton or Nomex, are also possible.

Furthermore, the electric motor 7 comprises bearings 21 for the motor output shaft 8. The bearings 21 are of the lubrication-free type, i.e. no greases or oils are required for the bearings to function correctly. The bearings 21 may comprise ceramic balls or a PEEK or bronze ball cage. It is advantageous for the bearings 21 to comprise a self-lubricating contact layer, for example in a groove in the bearings. The self-lubricating contact layer is preferably formed by a carbon-nitride layer. It has been found that such a material is well able to withstand the treatment medium (in particular supercritical $CO_2$), while sufficient lubrication of the bearings 21 is also achieved.

The bearings 21 are mounted in bearing blocks 23, which also form a type of covers for a motor casing 24 surrounding the electric motor 7. The bearing blocks 23 are made from a corrosion-resistant material, for example stainless steel or anodized aluminium.

Through-flow openings 26 (cf. FIG. 3) are provided in the bearing blocks 23 of the motor casing 24. This means that the electric motor 7 is of an open type and the treatment medium is free to circulate through the interior of the electric motor 7. This ensures successful cooling of the motor windings 20 and has the advantage that the motor casing 24 can be of more lightweight design, since the pressure inside the motor casing 24 is substantially equal to the pressure outside it. Furthermore, there is no need for any cooling fins, on account of the thermal properties of the treatment medium, and the motor shaft does not have to be passed through the motor casing 24 in such a manner as to be sealed with respect to the treatment medium at the supercritical process pressure.

The electric motor 7 is supplied with power via an electrical connection 27, which is provided with insulation material that is able to withstand the treatment medium, for example Nomex, aramid paper, kapton, polyester film and/or yarns. The electrical passage of the connection 27 through the wall of the pressure chamber 2 is provided with a tensile stress reliever which is able to withstand the treatment medium, for example a Buna-N ring or potting resin.

During operation, treatment medium is fed to the pressure chamber 2 via the feed 5*a*, and the electric motor 7 with the pump 9 is set in operation. Some of the treatment medium flows freely through the motor casing 24, where it has a cooling action, is sucked in by the pump 9 via the inlet 11 and is pumped by the mechanical action of the pump 9 to the outlet 12 or discharge 5*b*, leaves the pressure vessel 2 and enters another (first) pressure chamber (not shown), where the pieces of substrate are located, where it carries out a treatment on the pieces of substrate. After it has left the first pressure chamber, the treatment medium is fed back to the feed 5*a*, via an associated pipe. After the treatment medium which is circulating in this way has been able to act on the pieces of substrate for a desired time, the electric motor is stopped and the treatment medium is discharged from the system until the system is at ambient pressure, and then the treated pieces of substrate can be removed from the first pressure chamber again.

The pressure across the pump casing 10 in which, for example, an impellor of the pump is rotating is at most equal to the boost pressure provided by the pump 9, and is therefore advantageously only a few bar, while the treatment medium in the pressure chamber 2 may be at a high pressure.

Figure 4:
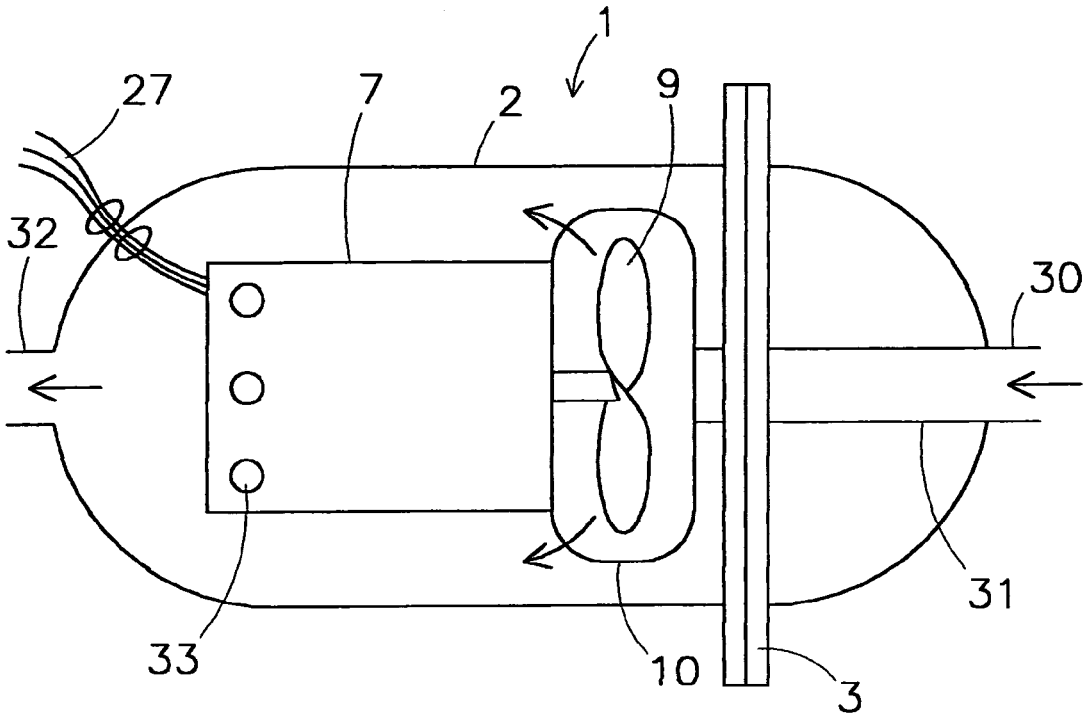
FIG. 4 shows a variant of FIG. 1 with the direction of flow reversed.

FIG. 4 shows a variant, in which identical components are denoted by the same reference numerals. The pressure chamber 2 is now provided with a feed 30 which is connected to an inlet 31 of the pump casing 10. There is also a discharge 32 which is in direct, open communication with the pressure chamber 2. Furthermore, through-flow openings 33 are now provided in the peripheral wall of the motor casing of the electric motor 7.

During operation, the treatment medium flows via the feed 30 and the inlet 31 into the pump casing 10 and from there flows partly through the electric motor 7 and partly around it into the pressure chamber 2 and then back out via the discharge 32.

Figure 5:
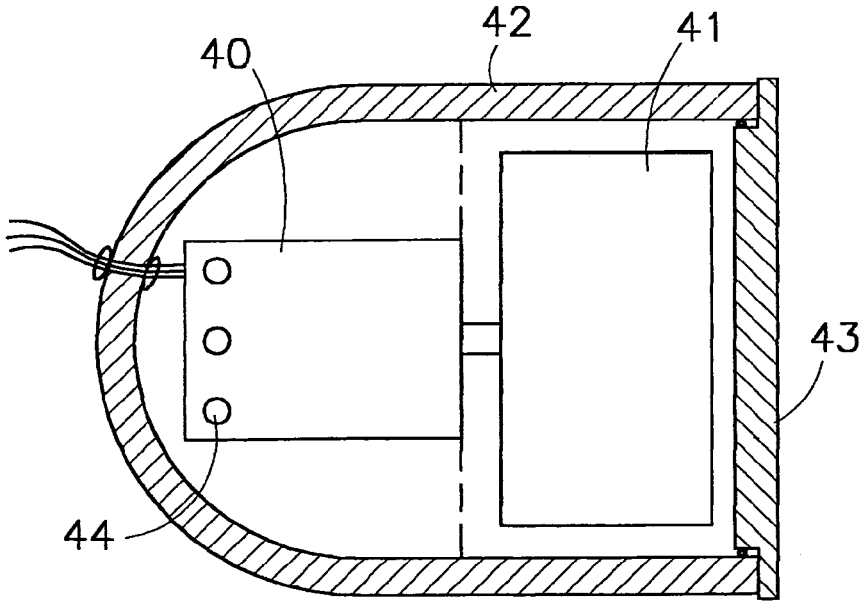
FIG. 5 shows a variant of FIG. 1 with a washing machine drum.

FIG. 5 shows an application in which an electric motor 40 and a drum 41 driven by it are positioned together in the same pressure chamber 42. Treatment medium can be fed to and discharged from the pressure chamber 42 (pipes not shown). The electric motor 40 is provided with through-flow openings 44, while the abovementioned measures according to the invention are preferably once again taken for the motor windings and the bearings used. The pressure chamber 42 is provided with a cover 43 which can be opened in order for pieces of substrate that are to be treated to be put into and taken out of the drum 41. The drum 41 can be used both for washing and for dyeing.

Figure 6:
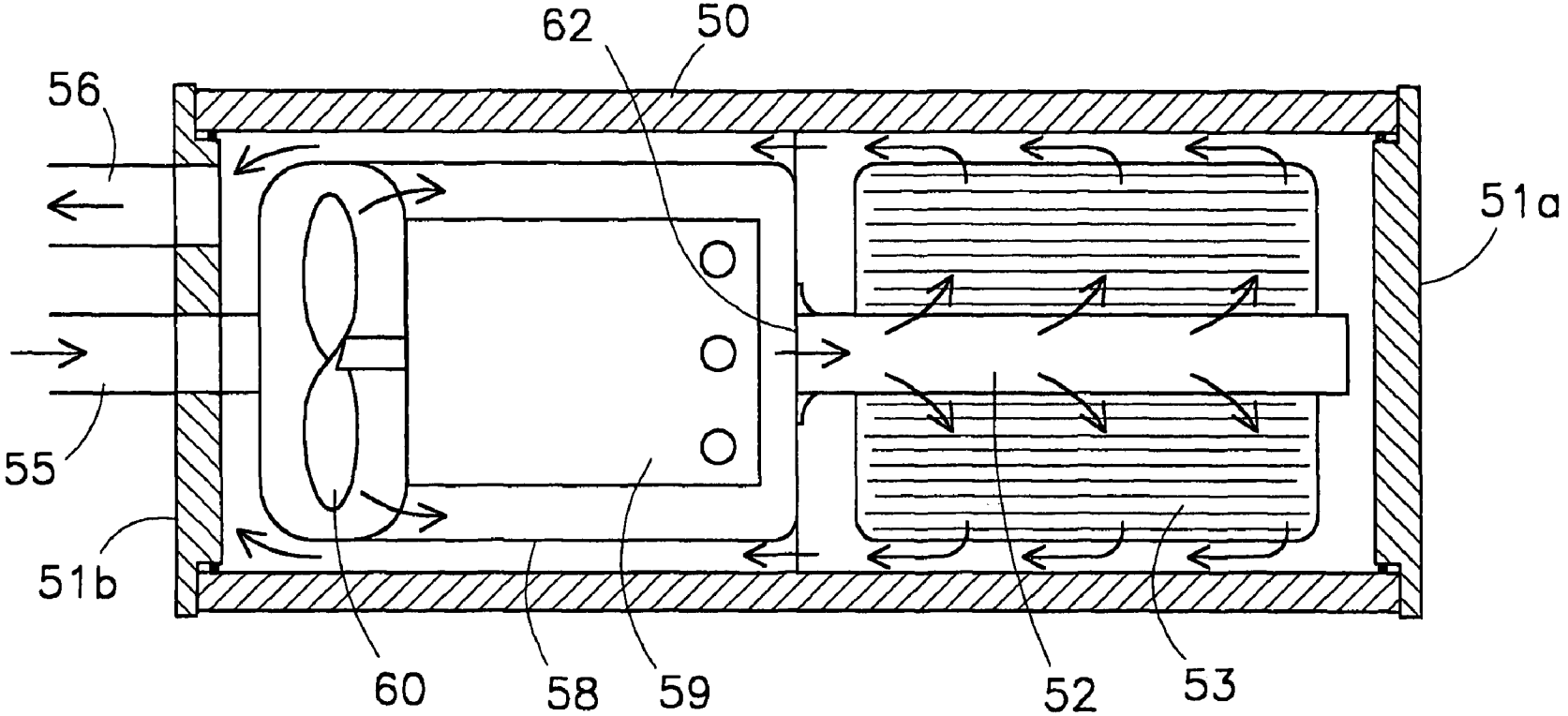
FIG. 6 shows a device according to the invention in which an electric motor with pump is accommodated in one pressure vessel, a beam dyeing machine interacting with it.

FIG. 6 shows a cylindrical pressure vessel 50 which is provided at both ends with feed openings which can be closed off by covers 51, 51*a* and 51*b*. Both the pressure chamber for the electric motor with actuator and the pressure chamber for the pieces of substrate are integrated in this pressure vessel 50. The cover 51*a* can be opened in order for a rolled-up piece of textile substrate 53 to be introduced into the pressure chamber on a perforated tube 52. The cover 51*b* is provided with a feed 55 and a discharge 56 for treatment medium. A pump casing 58, in which an electric motor 59 and a vane pump 60 are jointly accommodated, is directly connected to the feed 55. The pump casing 58 holding the electric motor 59 and the vane pump 60 can be mounted in the pressure vessel 50 when the cover 51*b* is open. The vane pump 60 is advantageously disposed upstream of the electric motor 59, which contributes to better flow of the treatment medium past and if desired through the electric motor 59, resulting in better cooling. From the pump casing 58, the treatment medium can flow via an outlet 62 into the tube 52 and from there, via the holes, through the substrate 53 that is to be treated, performing its treating action on the substrate. Finally, the treatment medium can leave the pressure chamber 50 again via the discharge 56. On account of the fact that the treatment medium has been laden with dye outside the pressure chamber 50, it is in this way possible to dye the textile substrate. The pressure drop across the textile substrate is approximately 1 bar.

In a preferred use, the treatment medium is supplied to the pressure chamber of the above-described devices at a pressure and temperature which are such that the treatment medium is in a supercritical or near-supercritical state. The entire pressure chamber, including the "open" electric motor, is then at the pressure and under the influence of the supercritical or near-supercritical treatment medium. Surprisingly, it has been found that this does not present any problems, in particular if the motor windings are insulated with insulation material that is able to withstand the treatment medium and if the bearing is of a lubrication-free type. For $CO_2$ as treatment medium, the supercritical state is reached at a pressure of at least 73 bar and a temperature of at least 31 degrees.

In a variant, the treatment medium is supplied to the pressure chamber of the above-described devices at a pressure and temperature which are such that the treatment medium is at least partially in a liquid phase. The "open" electric motor is then preferably submerged in the liquid treatment medium. Surprisingly, this too has been found not to present any problems, in particular if the motor windings are insulated with insulation material that is able to withstand the treatment medium and if the bearing is of a lubrication-free type.

In addition to the embodiments shown, numerous variants are possible. For example, it is also possible for other types of actuators in addition to the pump and the drum to be used to move the substrate and the medium with respect to one another, for example a propeller, an agitator or a stirring mechanism. In addition to washing or dyeing pieces of a textile substrate, the device can advantageously also be used to treat other types of substrate or to treat a substrate in another way, for example clean or degrease it. Examples of articles which can also be suitably treated using the device and the use according to the invention include fabrics, such as woven and nonwoven fabrics formed from materials such as cotton, wool, silk, leather, rayon, polyester, acetate, glass fibre, fur, etc. These fabrics may be formed into pieces, such as clothing, work gloves, cloths, leather goods (for example handbags and briefcases), etc. The present device and the use can also be used to treat, in particular wash, clean or degrease, other items, such as semiconductors, micro-electromechanical systems, opto-electronics, fibre optics and machined or cast metal components. It is also possible to treat foodstuffs and contaminated soil using the device and the use according to the invention.

Therefore, the invention provides a user-friendly, efficient device which allows an electric motor that can be of simple and inexpensive design to be positioned within the sphere of influence of a specific, aggressive type of treatment medium under various conditions of use in a pressure chamber.

What is claimed is:

1. Device for treating pieces of a substrate at high pressure, piece by piece or in batches, with a treatment medium in the supercritical or near-critical state, comprising:

a first pressure chamber, which is provided with a closable feed opening for placing the pieces of substrate in the pressure chamber;

a pipe system for supplying and discharging the treatment medium to and from the pressure chamber under high pressure, wherein the treatment medium is selected from the group consisting of $CO_2$, $N_2O$, ethane, propane, or mixtures thereof; and an electric motor, which is fixed in the first pressure chamber or in a second pressure chamber coupled to the first pressure chamber under high pressure, for driving an actuator to carry out a mechanical action in the treatment medium, the electric motor being open to the treatment medium and being disposed and designed to be accessible to the treatment medium, in such a manner that during the treatment of a substrate the supercritical or near-critical treatment medium flows through and around the electric motor, wherein the electric motor comprises an open motor casing which is provided with inlet openings for allowing the treatment medium to flow into the electric motor as far as around the motor windings.

2. Device according to claim 1, wherein motor windings of the electric motor are insulated using insulation material which is resistant to the treatment medium.

3. Device according to claim 2, wherein the insulation material for the motor windings is polyester.

4. Device according to claim 1, further comprising a lubrication-free bearing for a motor output shaft of the electric motor.

5. Device according to claim 4, wherein the bearing for the motor output shaft comprises a self-lubricating contact layer.

6. Device according to claim 4, further comprising a bearing block in which the bearing is mounted, wherein the bearing block is made from corrosion-resistant material.

7. Device according to claim 2, wherein the insulation material for the motor windings is selected in such a manner that it is able to withstand a treatment medium which is supplied at a pressure and temperature which are such that the treatment medium is in a supercritical or near-critical state in the pressure chamber.

8. Device according to claim 1, wherein the inlet openings are provided at one end of the motor casing.

9. Device according to claim 1, wherein the actuator driven by the electric motor is designed to cause the pieces of substrate and the medium to move with respect to one another.

10. Device according to claim 9, wherein the actuator is a pump.

11. Device according to claim 1, further comprising an electrical connection for the electric motor that is insulated using insulation material which is able to withstand the abovementioned treatment medium.

12. Device according to claim 1, wherein the actuator is a pump which, together with the electric motor is accommodated in a pump casing, which pump casing is accommodated in the first pressure chamber.

13. Device according to claim 12, wherein the pump casing is coupled on the suction side to a feed for the pipe system and opens out on the delivery side into a treatment space of the first pressure chamber.

14. Device according to claim 4, wherein the bearing for the motor output shaft is selected in such a manner that it is able to withstand a treatment medium which is supplied at a pressure and temperature which are such that the treatment medium is in a supercritical or near-critical state in the pressure chamber.

15. Device according to claim 6, wherein the corrosion-resistant material is stainless steel or aluminum.

16. Device according to claim 5, wherein the self-lubricating contact layer is a carbon-nitride layer.

17. Device according to claim 10, wherein the pump is a centrifugal pump.

* * * * *